US006318879B1

(12) United States Patent
Huang

(10) Patent No.: US 6,318,879 B1
(45) Date of Patent: Nov. 20, 2001

(54) TWO-PART FLASHLIGHT CONTROLLED BY ROTATION

(76) Inventor: Yu-Hwei Huang, No. 8 Lane 42, Sec. 2, Nan-Kan Rd., Lou-Choo Hsiang, Tao-Yuan Hsien (TW)

( * ) Notice: Subject to any disclaimer, the term of this patent is extended or adjusted under 35 U.S.C. 154(b) by 0 days.

(21) Appl. No.: 09/588,180

(22) Filed: Jun. 7, 2000

(51) Int. Cl.[7] ..... F21L 4/00
(52) U.S. Cl. ..... 362/205; 362/196; 362/202
(58) Field of Search ..... 362/157, 158, 362/186–188, 196, 202–206, 800

(56) References Cited

U.S. PATENT DOCUMENTS

| | | | | |
|---|---|---|---|---|
| 4,851,974 | * | 7/1989 | Maglica | 362/187 |
| 4,949,231 | * | 8/1990 | Wang | 362/205 |
| 5,560,705 | * | 10/1996 | Shiau | 362/188 |
| 6,224,236 | * | 5/2001 | Shu | 362/205 |

* cited by examiner

*Primary Examiner*—Alan Cariaso
(74) *Attorney, Agent, or Firm*—Dougherty & Troxell

(57) ABSTRACT

A two-part flashlight controllable by rotation, it has a hollow cylindrical main body including a closed end and an opening, an internal thread is provided near the opening. An end cover has an external threaded portion to connect the internal thread of the main body; the end cover has a transparent cover, an LED and an internal spring. Except the LED and other main elements, a battery set and a controlling switch are placed in the space formed by the end cover and main body to render the battery set and controlling switch to mutually press contact in cooperation with the spring. The switch includes an insulation sleeve, a metallic stem like spring seat having an upper and a lower enlarged end is inserted into the insulation sleeve, the upper enlarged end is abutted on a second spring provided in an enlarged inner hole in the insulation sleeve, the lower enlarged end can abut against and separate from a metallic contact in the insulation sleeve. The main body and the end cover determine the length of the flashlight and make the internal elements convenient for assembling and resistive to damage by dropping.

11 Claims, 8 Drawing Sheets

TWO-PART FLASHLIGHT CONTROLLED BY ROTATION

BACKGROUND OF THE INVENTION

1. Field of the Invention

The present invention is related to a two-part flashlight controllable by rotation, and especially to a flashlight using an LED lamp bulb and suitable specifically for use with articles carried on one's person, it is structurally simpler and stronger, and is convenient for operation.

2. Description of the Prior Art

In a conventional flashlight, a lamp bulb using a tungsten filament and conventional batteries are convenient for holding, however, such a conventional flashlight has quite a large volume and is inconvenient for carrying. While a conventional miniature flashlight only has a length of about 3–5 cm and a diameter of about 1.5–2.0 cm, it is convenient for put together with things carried on one's person such as keys.

In the recent years, semiconductors have been being continuously well developed; they can be made to have LED's of various colors without filaments, and can provide large and even super brightness. Such LED's with small volumes certainly can make the abovementioned miniature flashlight.

A conventional flashlight with a lamp bulb using a tungsten filament is provided with a threaded metallic sleeve on one end thereof to connect by screwing with a lamp seat having an inner thread. While an LED available now has two pins thereof exposed, when it is used for a flashlight, the connecting structure for the lamp seat must be completely different. A flashlight with such an LED available now is shown in FIG. 1, and is comprised of a cylindrical main body 10, a hood 11 is connected and locked on the top of the cylindrical main body 10, and a bottom cover 12 is provided on the bottom of the cylindrical main body 10; sequentially, there are a spring 13, an insulation sleeve 14, a set of batteries 15, a lamp seat 16, an LED 17 and a reflective cover 18 provided in the cylindrical main body 10. Wherein, two pins 171, 172 of the LED 17 can be inserted into the corresponding holes 161, 162 of the lamp seat 16 which can control on/off of the LED 17 by bouncing raising or lowering of the acting pieces 163, 164 movably mounted thereon. The flashlight of such a structure must have its battery set 15 changed at the bottom thereof, and turning on/off of the LED 17 is controlled with the hood 11, thereby, it must have three parts, i.e., the cylindrical main body 10, the hood 11 and the bottom cover 12. It is more complicated structurally, its length cannot be reduced further more, and the lamp seat 16 is very hard to manufacture by virtue that it shall cooperate with the LED 17 and the acting pieces 163, 164. Thereby, it is unstable in activating.

SUMMARY OF THE INVENTION

The object of the present invention is to provide a two-part flashlight controllable by rotation; the length of the flashlight contains a cylindrical main body and an end cover both being provided with a thread for adjustment and connecting. The end cover is provided therein with a lamp cover and a related lamp hood for a light emitting diode. The hollow interior formed from the cylindrical main body and the end cover can be placed therein a battery set and a controlling switch to abut against the light emitting device. A stem like spring seat provided in the controlling switch can control turning on/off of the LED by screwing tight or unscrewing of the end cover relative to the cylindrical main body. Thereby, such an LED flashlight can be minimized by virtue that it uses only two parts, and structural strength thereof can be increased to be resistive to damage by dropping.

The light emitting device can cooperate with another metallic pipe provided in the end cover to position a reflective cover of another LED.

The closed end of the above cylindrical main body can be mounted thereon a connecting member to be mounted on a related article.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
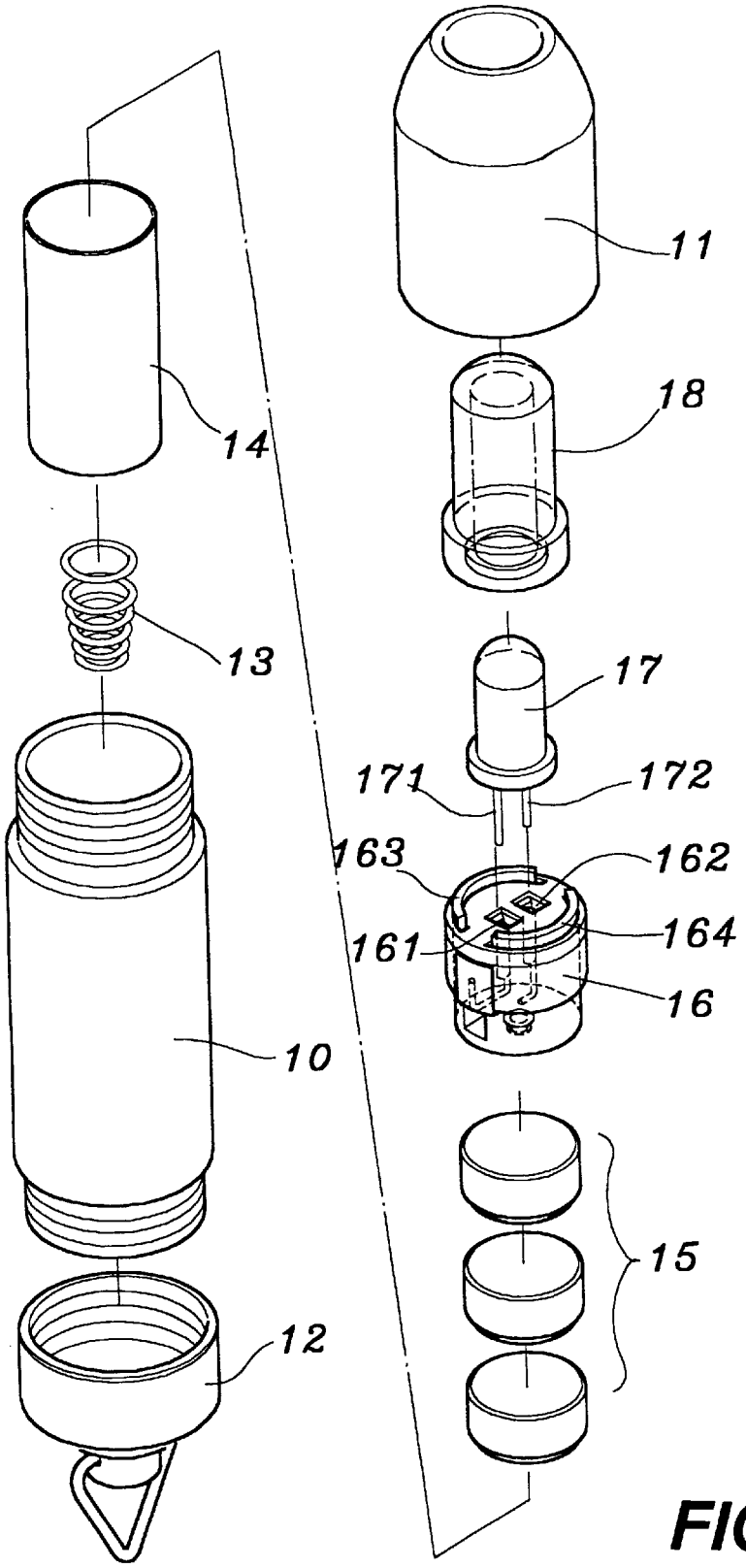
FIG. 1 PRIOR ART
FIG. 1 is an analytic perspective view showing the elements of a conventional LED flashlight.
Figure 2:
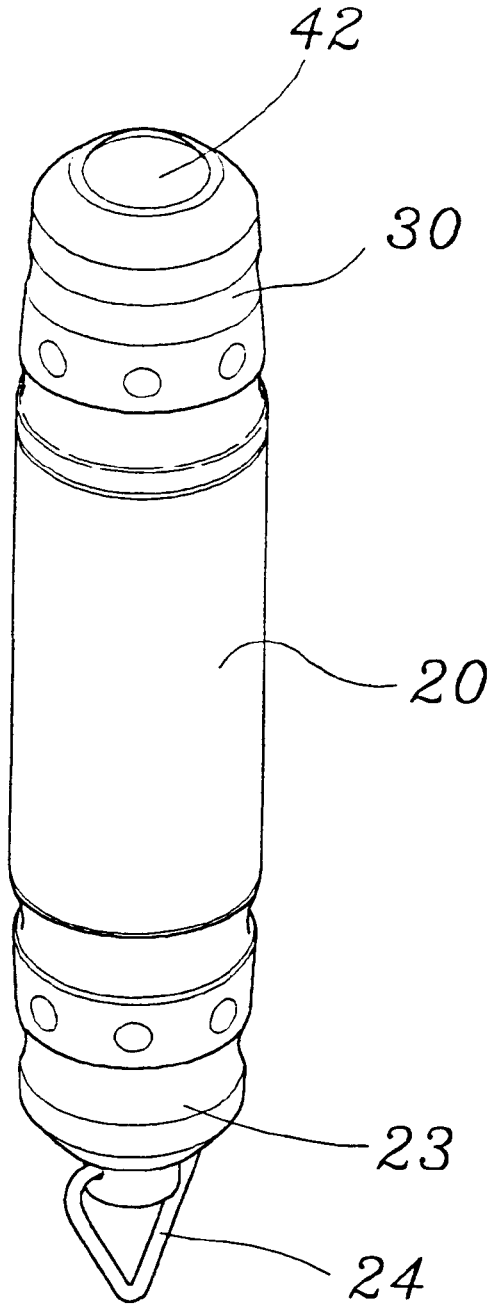
FIG. 2 is a perspective view of the first embodiment of the present invention.
Figure 3:
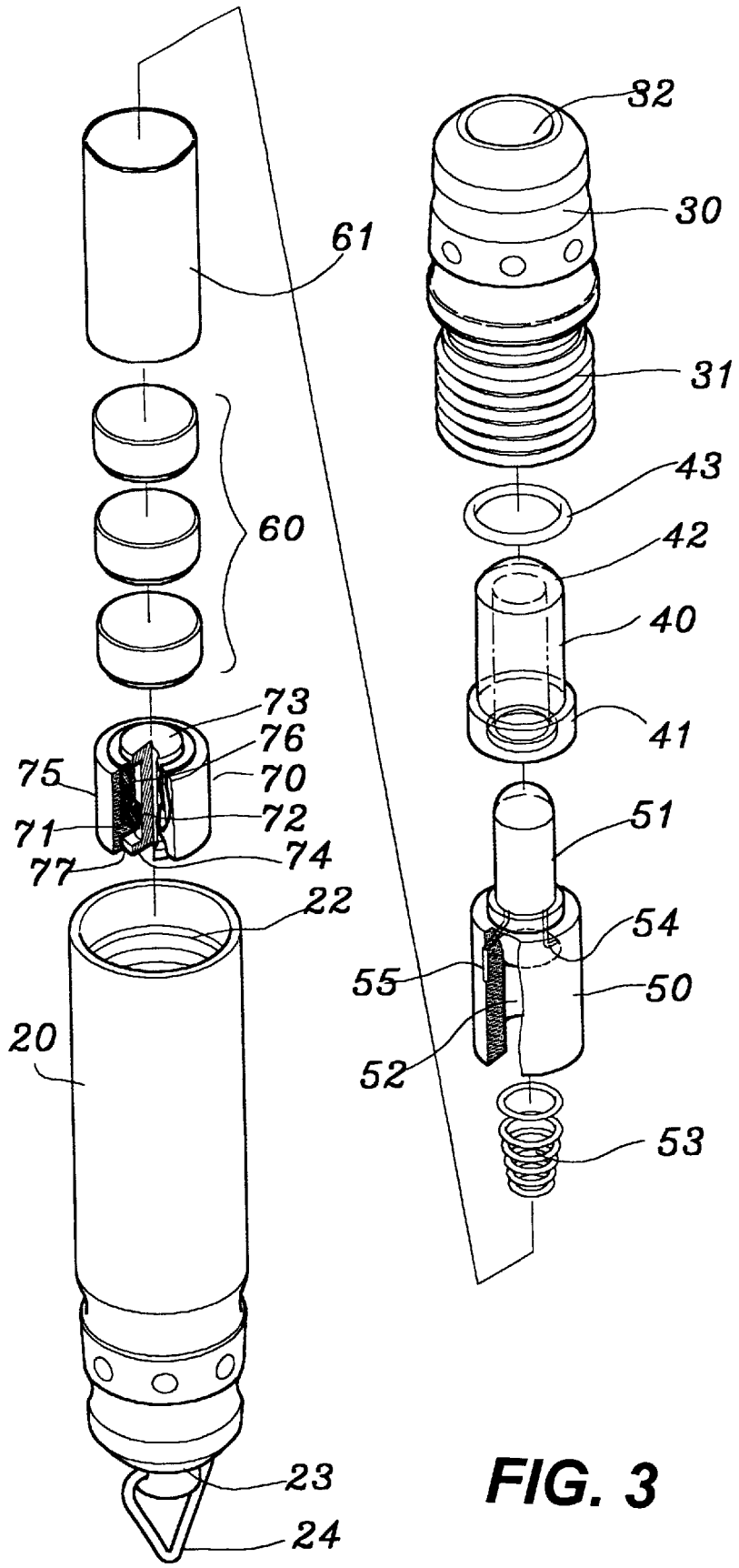
FIG. 3 is an analytic perspective view showing the elements of FIG. 2.

Referring to FIG. 2–3, the present invention has a hollow cylindrical main body 20 preferably made of metal and including an opening 21 on one end thereof, an internal thread 22 is provided near this opening 21; while the other end 23 thereof is a closed end adapted for providing a hanging means 24 which can be connected with an article carried on one's person (such as a key ring).

An end cover 30 also made of metal can be hollow too, and is provided with an external threaded portion 31 to connect with the internal thread 22 of the cylindrical main body 20. The end cover 30 can also be provided with a light penetrating hole 32 to be mounted thereon an LED or a related transparent or reflective cover. In the preferred embodiment shown in the drawings, a transparent cover 40 with a stepped flange 41 can be mounted in the end cover 30, the end 42 thereof exposes out from the light penetrating hole 32. A leak proof washer 43 is provided in the light penetrating hole 32 at the stepped flange 41.

A light emitting diode (LED) 51 mounted on an insulation lamp seat 50 can be inserted into the transparent cover 40; the lamp seat 50 basically is also cylindrical, and is provided with a hollow inner hole 52 for placing therein a spring 53. The light emitting diode (LED) 51 has one polar pin 54 thereof inserted into the inner hole 52 and abutted against an end of the spring 53, and has the other end 55 thereof bent and connected to the external wall of the lamp seat 50.

Figure 4:
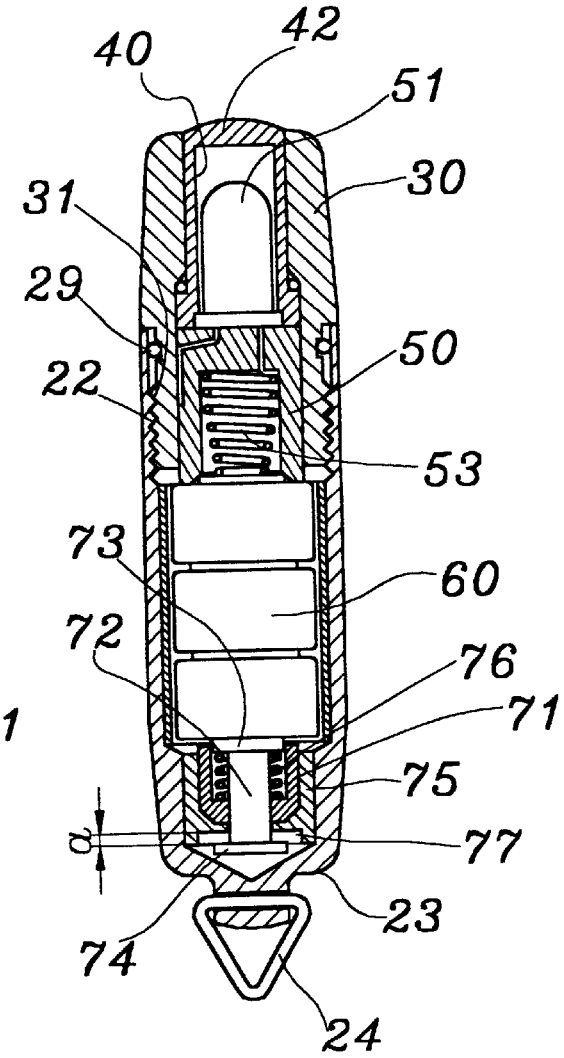
FIG. 4 is a sectional view taken from FIG. 2 showing the turning off state of the LED.

In addition to the abovementioned LED 51 and other related elements placed in the end cover 30, the main elements such as a battery set 60 and a controlling switch 70 etc. can be further placed in the interior space formed by the end cover 30 and the cylindrical main body 20. Referring simultaneously to FIG. 3 and 4, the battery set 60 placed in the interior space of the cylindrical main body 20 can be separated from the latter with an insulation sleeve 61; so that one end of the battery set 60 is abutted against the other end of the internal spring 53 of the lamp seat 50, and the other end of the battery set 60 is abutted against the controlling switch 70. The sequence of assembling of the battery set 60 and the controlling switch 70 is not certain; this will be described in more details in the following embodiments.

In the first preferred embodiment shown in FIG. 2–4, the controlling switch 70 includes an insulation sleeve 71, a metallic stem like spring seat 72 provided with an upper enlarged end 73 and a lower enlarged end 74 can be inserted into the insulation sleeve 71. In this embodiment, the insulation sleeve 71 is provided peripherally with a metallic contact 75. In addition to providing a hole for extending therein the stem like spring seat 72, the insulation sleeve 71 further is provided with an enlarged inner hole for a spring 76 which is abutted on one end thereof against the top surface of the enlarged inner hole and is abutted on the other end thereof against the upper enlarged end 73 of the stem like spring seat 72. The lower enlarged end 74 of the stem like spring seat 72 can be moved in the interior of a groove 77 provided in the metallic contact 75; it can be abutted against the groove 77 provided in the metallic contact 75 to make electric connection, and can be separated from the latter to disconnect.

Figure 5:
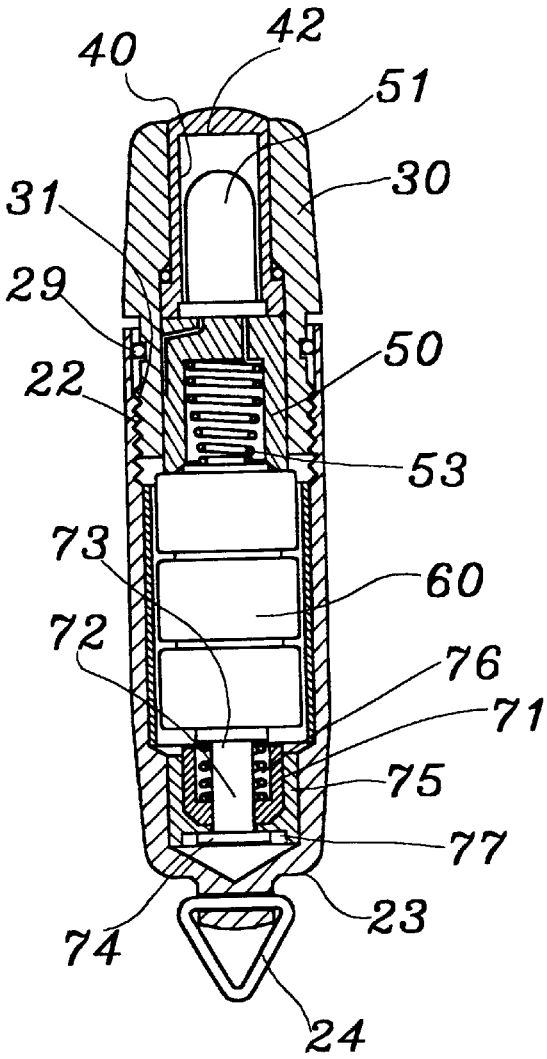
FIG. 5 is a sectional view as that of FIG. 4 showing the turning on state of the LED.
Figure 6:
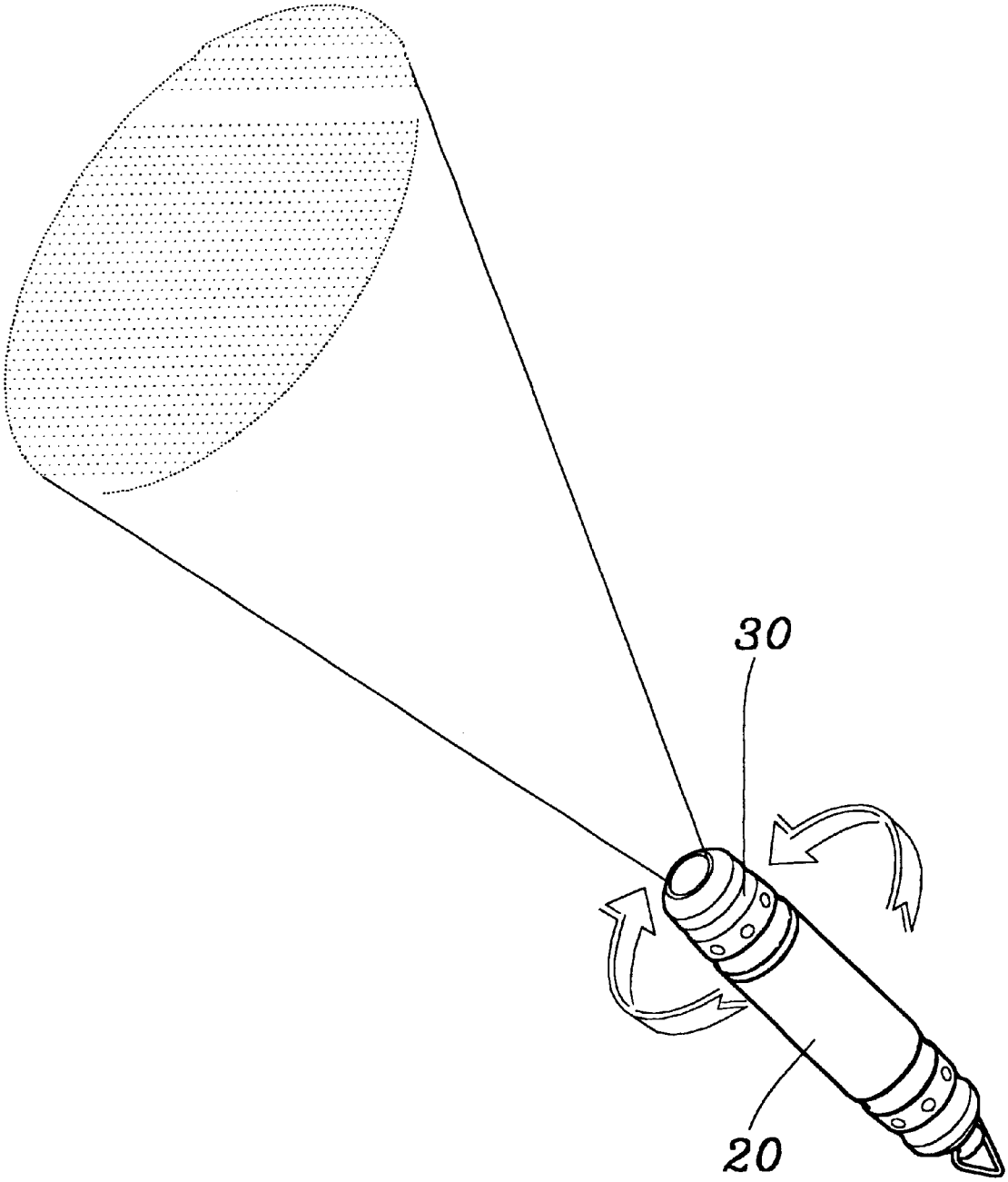
FIG. 6 is a schematic view showing the situation of use of the embodiment of FIG. 2.

As shown in FIG. 4, the cylindrical main body 20 and the end cover 30 are connected for locking with each other by means of the external threaded portion 31 which connects by rotation with the internal thread 22 (the joint area certainly can be provided with a leak proof washer 29), when they are rotated to be in position, by the mode of arrangement of the internal members, the whole stem like spring seat 72 will be pressed to render the lower enlarged end 74 thereof to get away a distance "a" from the groove 77 of the metallic contact 75 to result in electric disconnection, so that the light emitting diode (LED) 51 is not lightened. When they are rotated to be separated a certain distance from each other, as shown in FIG. 5, the lower enlarged end 74 of the stem like spring seat 72 will be subjected to an elastic force from the internal elastic member to contact the groove 77 to form electric connection, so that the light emitting diode (LED) 51 is lightened. By the fact that the flashlight can be minimized, it can be operated with one hand to rotate forwardly or reversely to be controlled by the LED for turning on/off as is shown in FIG. 6.

Figure 7:
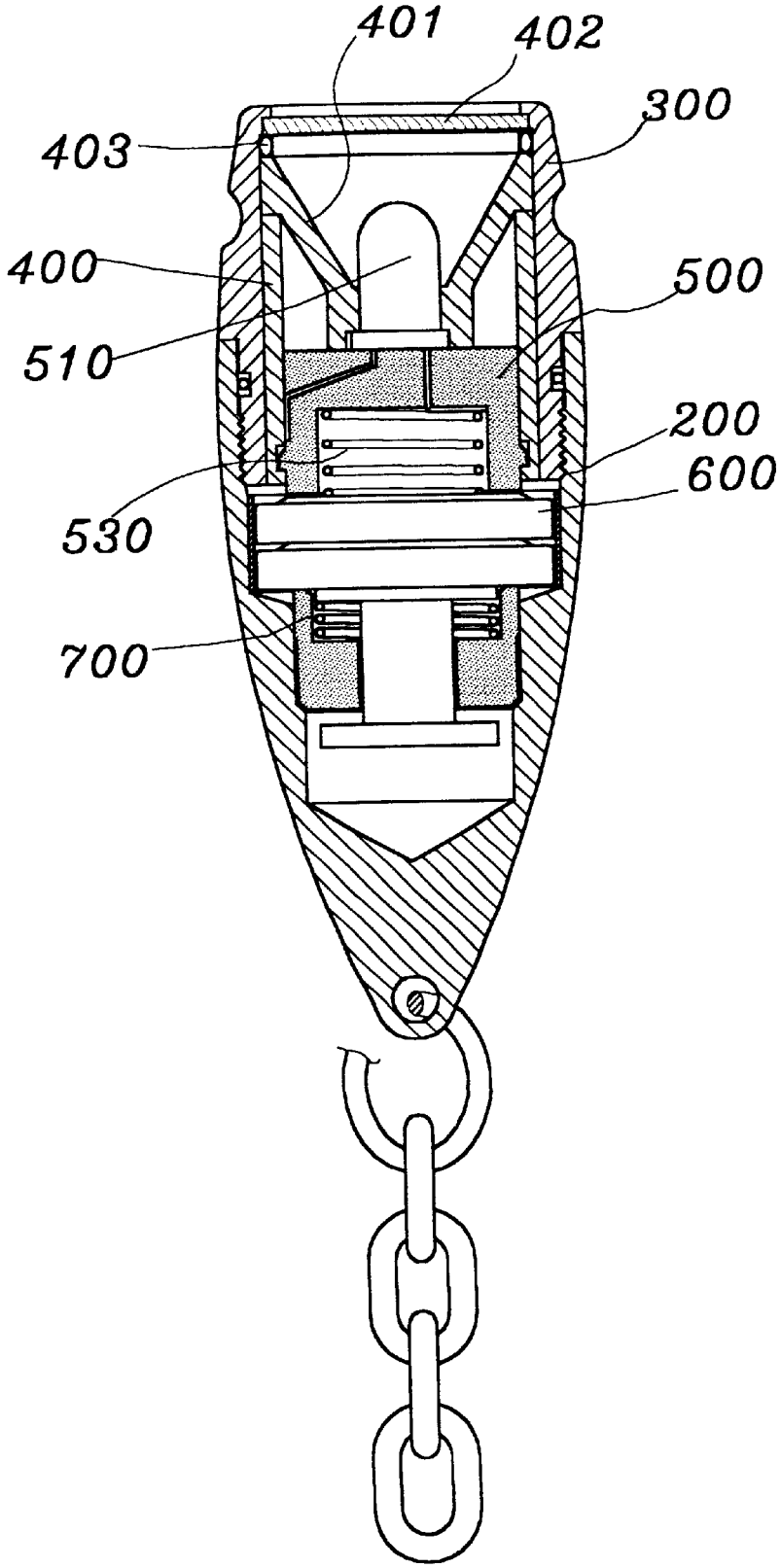
FIG. 7 is a sectional view showing the turning on state of the LED in the second embodiment of the present invention.
Figure 8:
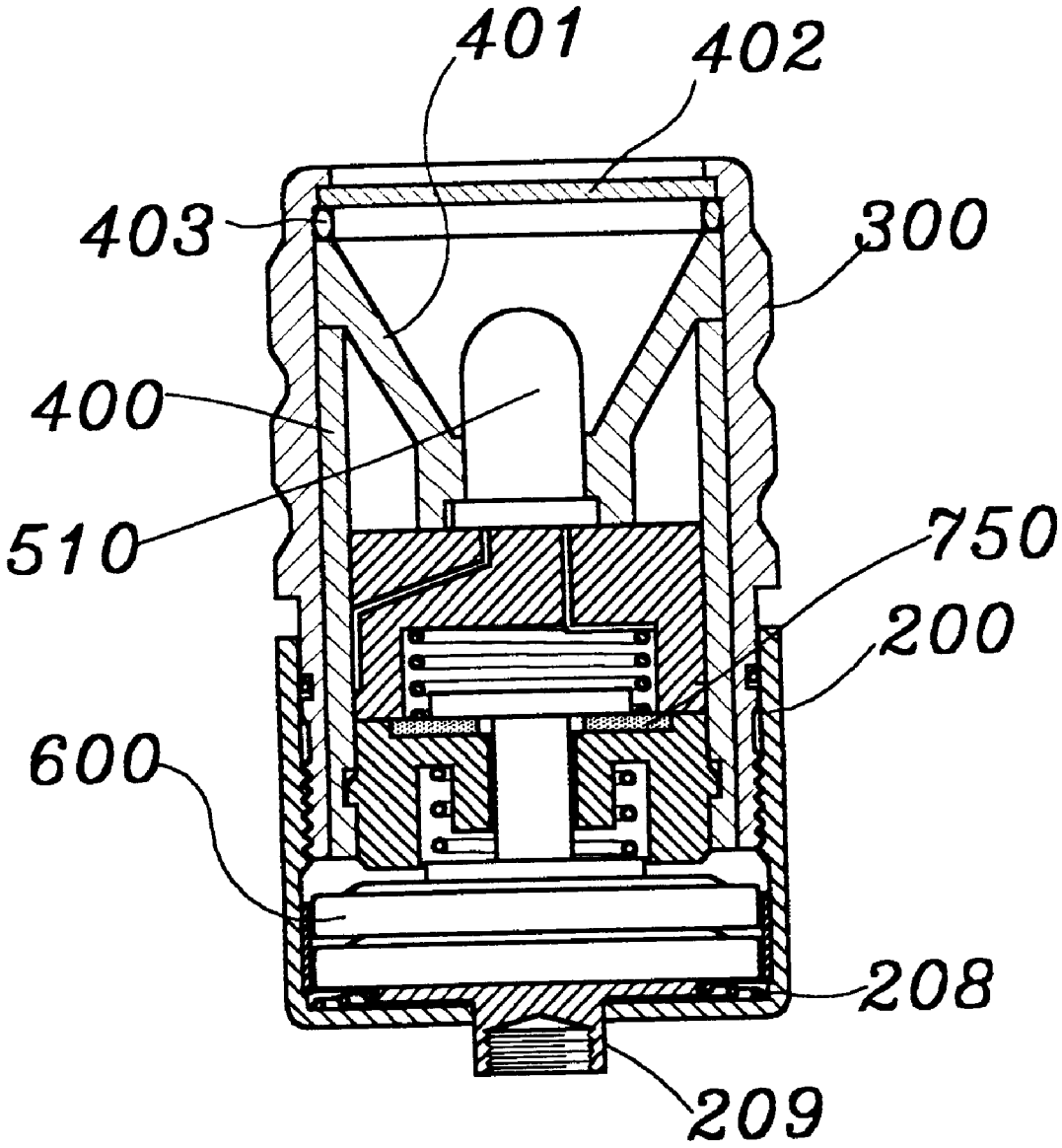
FIG. 8 is a sectional view showing the turning off state of the LED in the third embodiment of the present invention.
Figure 9:
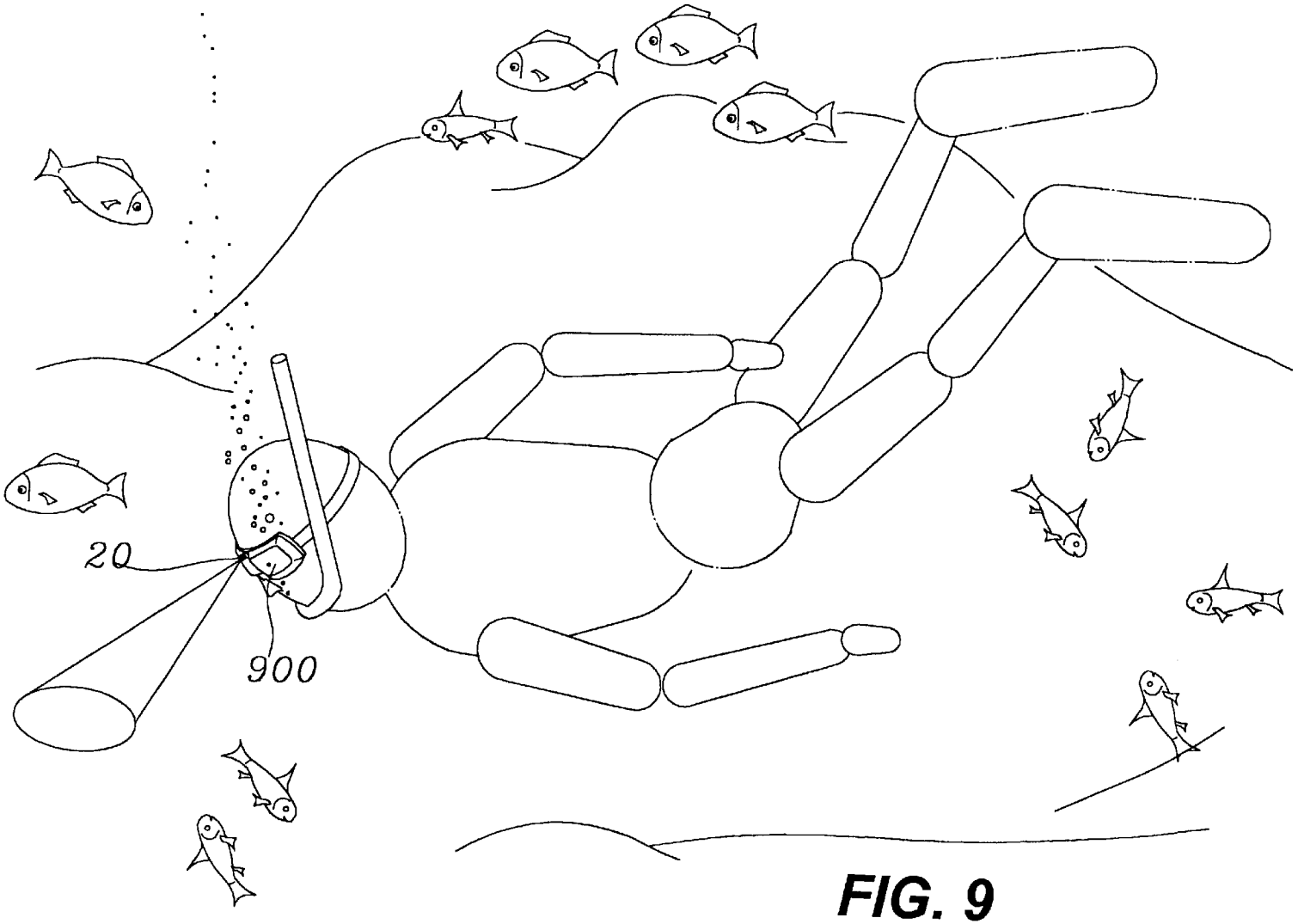
FIG. 9 is a schematic view showing the situation of use of the embodiment of FIG. 7.

In the second preferred embodiment shown in FIG. 7, there is provided an embodiment with a smaller length but with a larger illumination scope. For convenience of explanation, similar reference numbers are used herewith as those used in the former embodiment. This embodiment includes a cylindrical main body 200 and an end cover 300 connectable by threads with each other, and an insulation lamp seat 50 provided in the space formed together by the two parts, a light emitting diode (LED) 510, a battery set 600 and a controlling switch 700. This embodiment is further provided with a cylindrical metallic pipe 400 slipped in the inner wall of the end cover 300 to position a light converging cover 401 for enlarging reflection capability of the light emitting diode (LED) 510. In the preferred embodiment, another leak proof washer 403 is provided between the light converging cover 401 and a horizontal transparent glass 402. The end cover 300 is provided peripherally with a plurality of recesses 301 to allow fingers of a hand to hold to control the whole flashlight. FIG. 8 shows an embodiment similar structurally interiorly to that of FIG. 7 except that the internal battery set 600 and controlling switch 700 are provided at different positions, and a contact 750 is formed as a sheet, these are because that the present embodiment especially suits devices such as a diving hat 900 or a miner's helmet etc. The cylindrical main body 200 of the present embodiment can be added with threaded connecting member 209 to mount the flashlight on the devices as shown in FIG. 9. And more, in the embodiment of FIG. 8, in order to prevent loosening or strengthen contact, the space having the battery set 600 in the closed end of the cylindrical main body 200 can be added with a spring 208.

By the improved mode of assembling of the light emitting diode on the lamp seat in the present invention, and by providing a rotary controlling switch, the LED flashlight can structurally has only two parts. It is not only lighter and handy, but also is more suitable to be minimized and is a vibration proof structure which is more stable and resistive to damage by dropping. Therefore, it is industrial valuable.

Having thus described my invention, what I claim as new and desire to be secured by Letters Patent of the United States are:

1. A two-part flashlight controllable by rotation, said flashlight has a hollow cylindrical main body including a closed end on the bottom end and an opening on the upper end thereof, an internal thread is provided near said opening; an end cover being also hollow is provided with an external threaded portion to connect with said internal thread of said cylindrical main body; said end cover is provided with main elements including a transparent cover, an LED and a first internal spring; in addition to said LED and other main elements, a battery set and a controlling switch are further placed in the hollow interior space formed by said end cover and cylindrical main body to render said battery set and controlling switch to press contact with each other in cooperation with said first spring provided in a lamp seat; said controlling switch includes an insulation sleeve, a metallic stem like spring seat provided with an upper enlarged end and a lower enlarged end is inserted into said insulation sleeve, said upper enlarged end of said stem like spring seat is abutted against a second spring provided in an enlarged inner hole in said insulation sleeve, said lower enlarged end is adapted to abutting against a metallic contact in said insulation sleeve, and is adapted to separating from said metallic contact.

2. A two-part flashlight controllable by rotation as claimed in claim 1, wherein, said LED has a polar pin thereof extended into said cylindrical main body to contact said first spring, and has another polar pin thereof bent and connected to the external wall of said lamp seat.

3. A two-part flashlight controllable by rotation as claimed in claim 1, wherein, said transparent cover is provided with a stepped flange to be mounted in said end cover, so that the end thereof exposes out from a light penetrating hole provided on said end cover.

4. A two-part flashlight controllable by rotation as claimed in claim 1, wherein, said end cover is further slipped in the inner wall thereof a cylindrical metallic pipe to position a light converging cover.

5. A two-part flashlight controllable by rotation as claimed in claim 1, wherein, a metallic contact of said controlling switch is provided interiorly thereof with a groove, said metallic contact is adapted to abutting against and separating from said enlarged ends of said stem like spring seat.

6. A two-part flashlight controllable by rotation as claimed in claim 1, wherein, a metallic contact of said controlling switch is formed as a sheet convenient for abutment.

7. A two-part flashlight controllable by rotation as claimed in claim 1, wherein, said battery set provided in said hollow interior space formed by said end cover and cylindrical main body is mounted between said first spring provided in a lamp seat and said controlling switch.

8. A two-part flashlight controllable by rotation as claimed in claim 1, wherein, said controlling switch provided in said hollow interior space formed by said end cover and cylindrical main body is between said first spring provided in a lamp seat and said battery set.

9. A two-part flashlight controllable by rotation as claimed in claim 8, wherein, said battery set is provided on the bottom thereof with a third spring.

10. A two-part flashlight controllable by rotation as claimed in claim 1, wherein, said cylindrical main body is provided on a closed end thereof with a hanging means.

11. A two-part flashlight controllable by rotation as claimed in claim 1, wherein, said cylindrical main body is provided on a closed end thereof with a threaded connecting member.

* * * * *